US009596919B2

(12) United States Patent
Hwang

(10) Patent No.: US 9,596,919 B2
(45) Date of Patent: Mar. 21, 2017

(54) COSMETICS CONTAINER

(71) Applicant: F.S. KOREA INDUSTRIES INC., Seoul (KR)

(72) Inventor: Jae Kwang Hwang, Seoul (KR)

(73) Assignee: F.S. KOREA INDUSTRIES INC., Dobong-Ro, Gangbuk-Gu, Seoul (KR)

( * ) Notice: Subject to any disclaimer, the term of this patent is extended or adjusted under 35 U.S.C. 154(b) by 136 days.

(21) Appl. No.: 14/422,151

(22) PCT Filed: Aug. 23, 2013

(86) PCT No.: PCT/KR2013/007558
§ 371 (c)(1),
(2) Date: Feb. 17, 2015

(87) PCT Pub. No.: WO2014/030951
PCT Pub. Date: Feb. 27, 2014

(65) Prior Publication Data

US 2015/0223584 A1 Aug. 13, 2015

(30) Foreign Application Priority Data

Aug. 23, 2012 (KR) ..... 10-2012-0092187

(51) Int. Cl.

| | |
|---|---|
| ***A45D 40/28*** | (2006.01) |
| ***A45D 34/04*** | (2006.01) |
| ***B65D 83/00*** | (2006.01) |
| ***A45D 40/26*** | (2006.01) |

(52) U.S. Cl.
CPC ..... *A45D 40/28* (2013.01); *A45D 34/042* (2013.01); *A45D 40/262* (2013.01); *B65D 83/0011* (2013.01); *A45D 2200/055* (2013.01)

(58) Field of Classification Search
CPC .... A45D 34/042; A45D 40/06; A45D 40/262; A46B 7/04; B65D 83/0011
USPC ..... 401/74, 174
See application file for complete search history.

(56) References Cited

U.S. PATENT DOCUMENTS 4,122,983 A * 10/1978 Jolly ..... A46B 11/0027 401/175
2010/0014909 A1* 1/2010 Sampaio ..... A46B 7/04 401/268

FOREIGN PATENT DOCUMENTS

| | | |
|---|---|---|
| JP | 2008-307082 | 12/2008 |
| KR | 20-0441218 | 7/2008 |
| KR | 10-2009-0059607 | 6/2009 |
| KR | 10-2010-0119253 | 11/2010 |
| KR | 10-1116842 | 3/2012 |

* cited by examiner

*Primary Examiner* — Jennifer C Chiang
*Assistant Examiner* — Bradley Oliver
(74) *Attorney, Agent, or Firm* — East West Law Group; Heedong Chae

(57) ABSTRACT

A cosmetics container according to the present invention is capable of preventing alien substances from being introduced into the discharge port by arranging the discharge port through which the cosmetics are discharged and the applying member for applying the cosmetics on a skin, which are located independent of each other. In addition, the cosmetics container according to the present invention is capable of preventing a space from being formed inside the discharge port and preventing air or alien substances from being introduced into a vessel containing the cosmetics since the piston is only moved upward by manipulation of a user while preventing the piston from being moved downward.

8 Claims, 12 Drawing Sheets

COSMETICS CONTAINER

CROSS-REFERENCE TO RELATED APPLICATION

This application claims the benefit of Korean Application No. 10-2012-0092187, filed on Aug. 23, 2012 with the Korean Intellectual Property Office, the disclosure of which is incorporated herein by reference.

BACKGROUND OF THE INVENTION

Field of the Invention

The present invention relates to a cosmetic container including a discharge port through which cosmetics are discharged, and an applying member, which are formed independently.

Description of the Related Art

In general, when using cosmetics accommodated in a cosmetic container, a user removes some of the cosmetics onto his palms and takes and applies the cosmetics on his skins with a tool or hands.

However, when removing the cosmetics onto the palms, the amount of removed cosmetics is not uniform and the cosmetics may be wasted since the cosmetics are more removed than necessary.

On the one hand, in a case where cosmetics are spread and applied cm a face, a discharge port through which the cosmetics are discharged and a brush for applying the discharged cosmetics on the face are integrated at the same position, which may result in hardening of the cosmetics in the brush and holding of alien substances in the brush.

Therefore, when the contaminated brush is cleaned or washed, contaminants or water may penetrate into the discharge port through which the cosmetics are discharged.

Related Technical Document (Patent Document) KR Utility Model 20-2009-0011706 A

SUMMARY OF THE INVENTION

It is an object of the present invention to provide a cosmetics container including a discharge port through which cosmetics are discharged, and an applying member, which are formed independently.

It is another object of the present invention to provide a cosmetics container in which a discharge port through which cosmetics are discharged and a brush for applying the discharged cosmetics on a skin are disposed at different positions, thereby preventing alien substances and water from being introduced through the discharge port when the brush is washed.

It is still another object of the present invention to provide a cosmetics container which is capable of preventing cosmetics from retreating into a discharge port only by moving a piston upward to discharge the cosmetics while preventing the piston from being moved downward when a user attempts to discharge the cosmetics.

To achieve the above objects, according to an aspect of the invention, there is provided a cosmetics container including: a discharge head (200) including a discharge port (210) and an applying member which are formed independent of each other; an upper body (100) which is combined and assembled to the discharge head (200) and contains cosmetics; a piston (325) which is disposed in the upper body (100) and pressurizes and discharges the contained cosmetics to the discharge port (210); and a lower body (300) which is combined to the upper body (100) and discharges the cosmetics by moving the piston (325) to the discharge port (210) through rotation relative to the upper body (100).

The applying member may be at least one of a brush and a sponge.

The applying member may be installed to be detached from the discharge head (200).

The applying member may be disposed in the opposite side to the discharge port (210).

The discharge head may include: a head base (530) which is combined and fixed to the upper body (100) and guides the cosmetics pressurized through the piston (325) of the upper body (100); and a head cover (550) which is combined to the head base (530) and has the applying member and the discharge port (210) formed in the outer side of the head cover (550), wherein a head base passage (534) and a head cover passage (554) guiding the cosmetics pressurized in the upper body (100) to the discharge port (210) are formed in the head base (530) and the head cover (550), respectively, and are interconnected.

The lower body (300) may include: a lower shell (302) formed therein with an empty space; a guide shaft (310) formed in the empty space of the lower shell (302); a screw cap (330) combined and fixed to the upper body (302); a screw shaft (320) whose upper side is fixed to the piston (325) and whose lower side is assembled with the guide shaft (310), wherein the screw shaft (320) is horizontally rotated along with the guide shaft (310) and is axially relatively moved along the guide shaft (310) to move the piston (325) upward and the screw shaft (3200 has axial threads (324) formed in the circumferential surface; and an interference part (335) which has cap threads (334) formed to cause mutual interference with the axial threads (324), is formed in the screw cap (330), raises the screw shaft (320) by mutual engagement of the axial threads (324) and the cap threads (334) when the upper body (100) and the lower body (300) are forward rotated relative to each other, and releases the mutual engagement of the axial threads (324) and the cap threads (334) while being bent by the mutual interference when the upper body (100) and the lower body (300) are backward rotated relative to each other.

The interference part (335) may formed in an L-like shape and is deformed to be bent outward in the radial direction of the screw cap (330) in the backward rotation.

The interference part (335) may be formed in a cantilever shape in the inner side of the screw cap (330).

The piston (325) may be moved to the discharge port (210) through mutual interference by engagement of the axial threads (324) and the cap threads (334) when the lower body (300) is forward rotated relative to the upper body (100), and the screw axis (320) may be idle rotated in place as the cap threads (334) is separated from the axial threads (324) by the bending deformation of the interference part (335) when the lower body (300) is backward rotated relative to the upper body (100).

The cosmetics container according to the present invention is capable of preventing alien substances from being introduced into the discharge port when a brush is cleaned by arranging the discharge port through which the cosmetics are discharged and the applying member for applying the cosmetics on a skin, which are located independent of each other.

In addition, the cosmetics container according to the present invention is capable of preventing a space from being formed inside the discharge port and preventing air or alien substances from being introduced into a vessel containing the cosmetics since the piston is only moved upward by manipulation of a user while preventing the piston from being moved downward.

In addition, the cosmetics container according to the present invention is capable of preventing the cosmetics from being excessively discharged and wasted since the amount of discharge of cosmetics can be adjusted depending on the rotational speed of the lower body (300).

BRIEF DESCRIPTION OF THE DRAWINGS

The above and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENT

Figure 1:
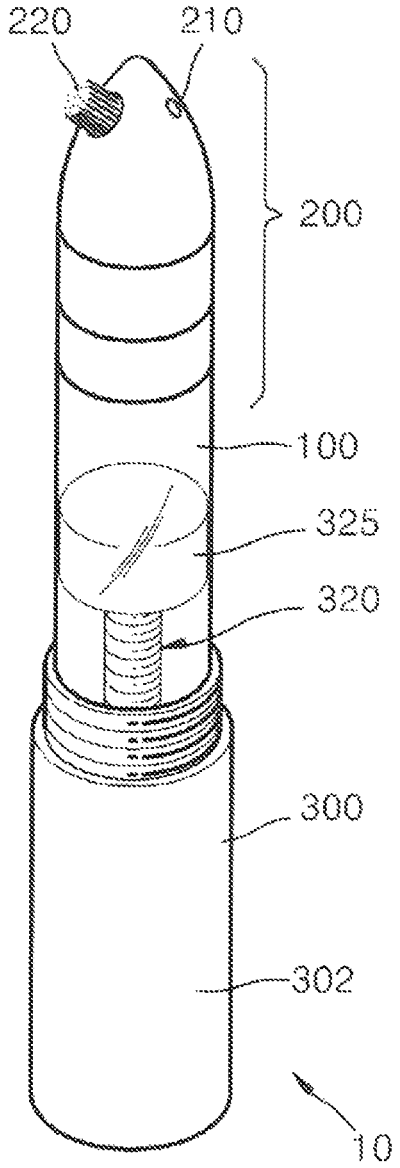
FIG. 1 is a perspective view of a cosmetics container according to a first embodiment of the present invention.

Hereinafter, preferred embodiments of the present invention will be described in detail with reference to the accompanying drawings. In the following detailed description of the present invention, concrete description on related functions or constructions will be omitted if it is deemed that the functions and/or constructions may unnecessarily obscure the gist of the present invention. In the specification, it is noted that different portions to be displayed for the same terms may be denoted by different reference numerals.

Terms used in the specification are employed in consideration of functions in the present invention and may be varied depending on intention of a user such as an experimenter or a measurer and, therefore, definitions thereof is to be based on contents throughout the specification.

Ordinal terms such as "first", "second" and the like used in the specification may be used to explain various elements which should not be limited by these ordinal terms. These ordinal terms should be only used to distinguish one element from another element. For example, without departing from the scope of the present invention, a first element may be named a second element and vice versa. The term "and/or" is intended to include all, some or one of multiple elements.

Terms used in the specification are only used to explain specific embodiments but is not intended to limit the present invention. A singular form such as "a" or "an" is intended to include a plural form unless stated explicitly otherwise.

Unless defined otherwise, all terms used herein, including technical or scientific terms, have the same meanings as those generally understood by those skilled in the art to which the present invention belongs. Terms as defined in dictionaries used in common should be construed as having the same meanings as those in the context of the related art but should not be construed as having ideal or unduly formal meanings.

When any part is said to "comprise" any element, this means that the part may further include other elements rather than excluding the other elements, unless stated particularity contrariwise.

Figure 2:
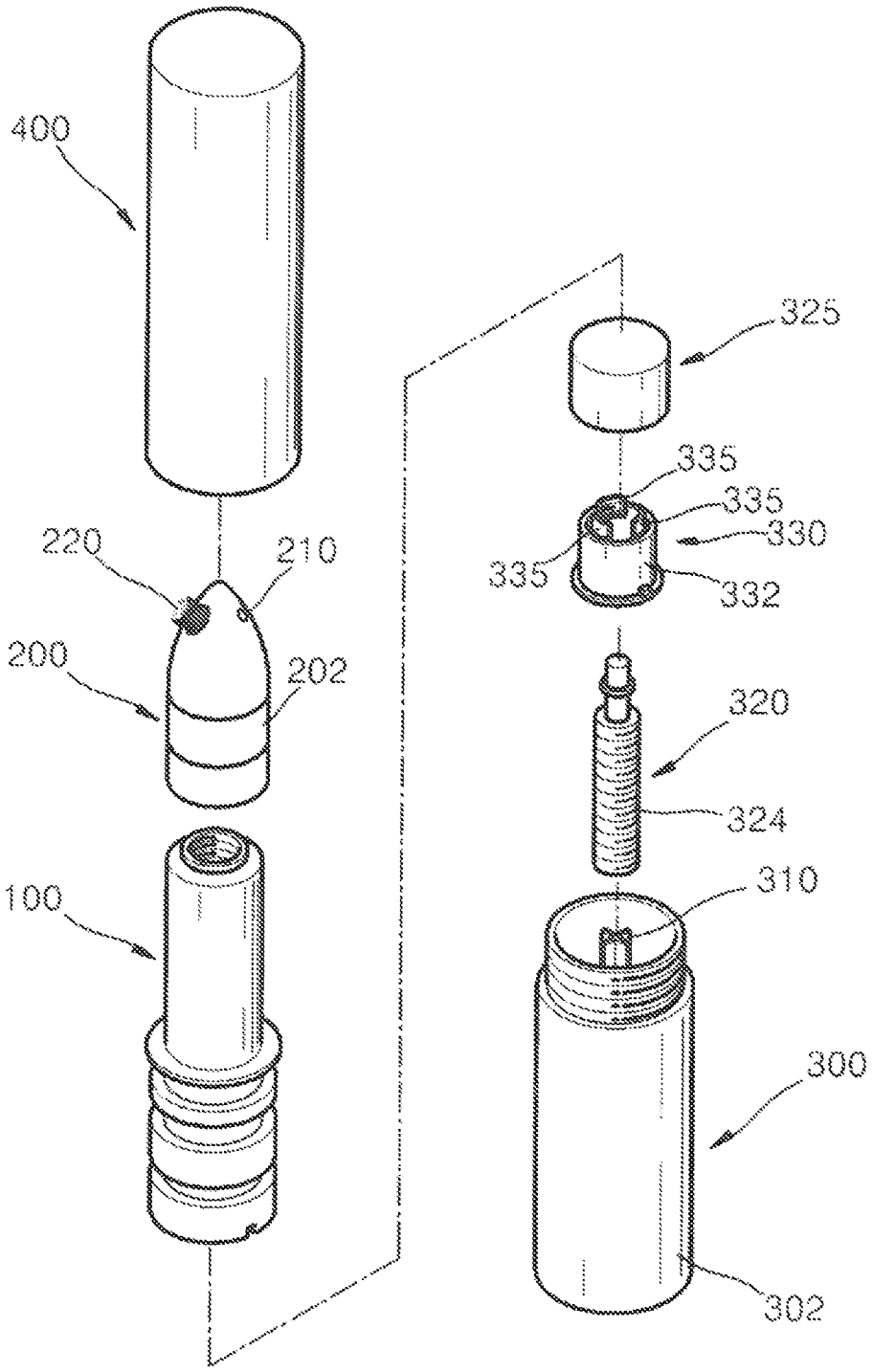
FIG. 2 is an exploded perspective view of the cosmetics container shown in FIG. 1 and a protective cap.
Figure 3:
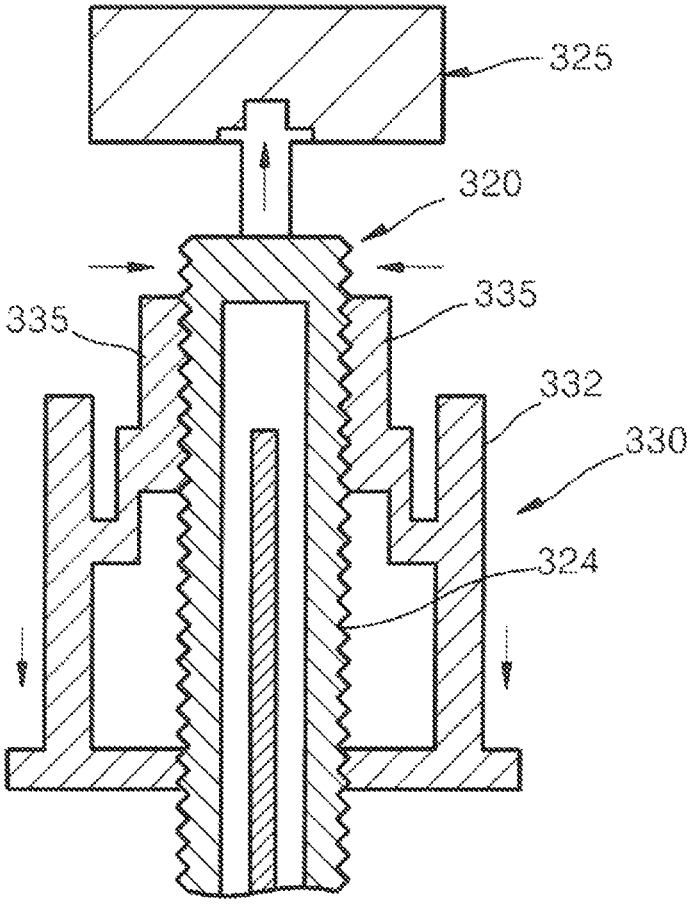
FIG. 3 is a sectional view showing a combination structure of a screw cap and a screw shown in FIG. 1.
Figure 4:
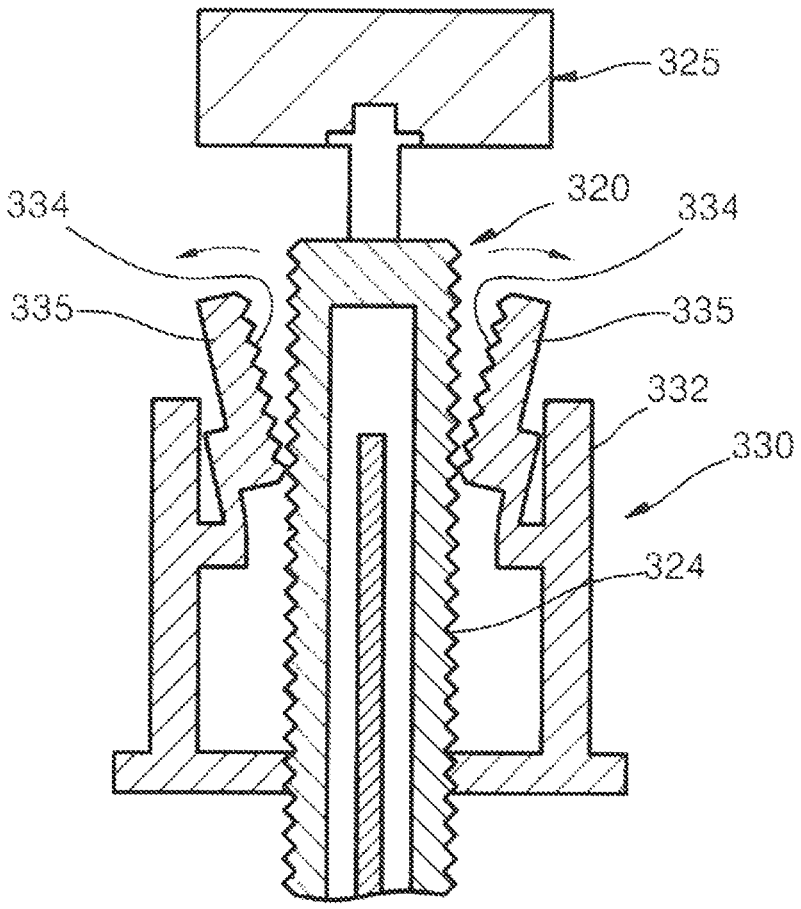
FIG. 4 is a view showing an example of operation of FIG. 3.

FIG. 1 is a perspective view of a cosmetics container according to a first embodiment of the present invention, FIG. 2 is an exploded perspective view of the cosmetics container shown in FIG. 1 and a protective cap, FIG. 3 is a sectional view of a retreat prevention module shown in FIG. 1, and FIG. 4 is a view showing an example of operation of FIG. 3.

As shown, a cosmetics container 10 according to this embodiment includes a lower body 300 within which a screw shaft 320 is installed, an upper body 100 which is combined to the upper side of the lower body 300, contains cosmetics and includes a piston 325 for pressurizing the cosmetics while moving upward, a retreat preventing member which is combined and fixed to the piston 325, raises the piston 325 by mutual interference with the screw 320 while being rotated relative to the screw 320 when the lower body 300 is rotated forward, and prevents the piston 325 from being lowered by release of the mutual interference while being rotated relative to the screw 20 when the lower body 300 is rotated backward, a discharge head 200 including a discharge port 210 which is combined to the upper side of the upper body 100, is supplied with cosmetics by raising of the piston 325 and discharges the supplied cosmetics and an applying member 220 for applying the cosmetics, with the discharge port 210 and the applying member 220 formed independently, and a protective cap 400 which is combined to the upper side of the lower body 300 and is inserted therein with the discharge head 200 and the upper body 100.

The discharge head 200 is formed in a conical shape in this embodiment but may be formed in different shapes without being limited to the shape of this embodiment.

The discharge head 200 includes a discharge head body 202 formed with an internal space, the discharge port 210 which is formed in the discharge head body 202 and through which the internal supplied cosmetics are discharged, and the applying member 220 which is formed in the discharge head body 201 and applies the cosmetics uniformly in contact with a user's skin.

The discharge port 210 and the applying member 220 are located in different directions so as to prevent water or alien substances from being introduced in the discharge port 210 when the applying member 220 is washed.

In particular, in this embodiment, the applying member 220 and the discharge port 210 are arranged in the opposite direction.

Although the applying member 220 is illustrated with a brush in this embodiment, various different members may be used.

When the brush is used for an extended period of time, alien substances or hardened cosmetics to be washed out remain in the brush.

When the applying member 200 is washed in this manner, if a distance between the discharge port 210 and the applying member 220 is small, alien substances or water is introduced into the discharge port 210 during the washing, which may result in poor quality of the cosmetics.

In order to prevent this, in this embodiment, in addition to independent arrangement of the discharge port 210 and the applying member 220, they are arranged in different directions, thereby minimizing a possibility of introduction of alien substances into the discharge port 210.

The upper body 100 is combined to the discharge head 200 and contains the cosmetics.

Here, as the cosmetics contained in the upper body 100 are pushed by upward movement of the piston 325, the cosmetics are discharged to the discharge port 210.

The upper body 100 and the lower body 300 are configured to foe rotated relative to each other. When the lower body 300 is relatively rotated forward, the piston 325 disposed in the upper body 100 is moved upward. When the lower body 300 is relatively rotated backward, the piston 325 remains stayed without being lowered downward.

The lower body 300 includes a lower shell 302 formed therein with an empty space, a guide shaft 310 formed in the empty space of the lower shell 302, a screw cap 330 combined and fixed to the upper body 302, a screw shaft 320 which is combined to the guide shaft 310 in such a manner that the screw shaft 320 is horizontally rotated along with the guide shaft 310 and is axially relatively moved along the guide shaft 310, and has axial threads formed in the circumferential surface, an interference part 335 which has cap threads 334 formed to cause mutual interference with the axial threads 324, is fixed in the form of a cantilever to the screw cap 330, raises the screw shaft 320 by mutual engagement of the axial threads 324 and the cap threads 334 when the upper body 100 and the lower body 300 are forward rotated relative to each other, and releases the mutual engagement of the axial threads 324 and the cap threads 334 while being bent by the mutual interference when the upper body 100 and the lower body 300 are backward rotated relative to each other, and the piston 325 which is combined to the top of the screw shaft 320 and pressurizes the cosmetics contained in the upper body 100 to the discharge port 210.

The guide shaft 310 is axially installed in the lower shell 302.

The screw shaft 320 is combined in such a manner that the guide shaft 310 is inserted therein, so that the screw shaft 320 can be vertically relatively moved while being horizontally rotated along with the guide shaft 310.

The screw shaft 320 interferes mutually with the screw cap 330 through the axial threads 324 and the cap threads 334.

Since the screw cap 330 is combined and fixed to the upper body 100, when the upper body 100 and the lower body 300 are relatively rotated, the axial threads 324 and the cap threads 334 interfere with each other to make or release the engagement.

In this embodiment, when the lower body 300 is forward rotated, the screw shaft 320 is raised by the mutual interference of the axial threads 324 and the cap threads 334.

The screw cap 330 includes a cap body 332 formed with a hollow through which the screw shaft 320 passes, and the interference part 335 projects inward from the cap body 332 and is fixed in the form of an L-like cantilever to the cap body 332.

The interference part 335 can be easily deformed when ail external force is applied thereto. In this embodiment, the interference part 335 is formed to be deformed in the radial direction of the cap body 332.

Here, when the upper body 100 and the lower body 300 are forward relatively rotated, the mutual engagement of the axial threads 324 and the cap threads 334 forces the screw shaft 320 to move upward and the interference part 335 to move downward.

Thus, when the axial threads 324 and the cap threads 334 interfere with each other as the lower body 300 is forward rotated, the interference part 335 is deformed to be close to an axial center by the engagement of the axial threads 324 and the cap threads 334, thereby achieving correct mutual, interference of the axial threads 324 and the cap threads 334.

Through this process, while being relatively moved upward along the guide shaft 310, the screw shaft 320 moves the piston 325 upward to pressurize the cosmetics to the discharge port 210.

On the other hand, when the lower body 300 is backward rotated, the interference part 335 is forced to move upward, at which point of time the upper end thereof is deformed to be bent outward from the axial center of the screw shaft 320 in the radial direction and the mutual engagement of the axial threads 324 and the cap threads 334 is released by the bending deformation of the interference part 335, thereby making the screw shaft 320 idle in place.

Therefore, when the lower body 300 is backward rotated, since the screw shaft 320 does is not moved downward while being idle in place, the piston 325 stays in place without being moved downward.

That is, in the cosmetics container according to this embodiment, the cosmetics are normally discharged through the discharge port 210 when the lower body 300 is forward rotated, and the piston 325 is located in place when the lower body 300 is backward rotated.

Therefore, even when a user rotates the lower body 300 in an incorrect direction and then rotates the lower body 300 in the correct direction, the cosmetics can be immediately discharged, thereby preventing a delay due to malfunction by the user.

In addition, even when the lower body 300 is backward rotated by the user, the piston 325 is not moved downward, thereby preventing an empty space from being formed in the discharge port 210 and hence preventing alien substances or wafer from being introduced into the discharge head 200 and being mixed with the cosmetics.

In addition, in the cosmetics container according to this embodiment, the amount of discharge of the cosmetics can be adjusted depending on the rotational speed of the lower body 300, thereby preventing the cosmetics from being excessively discharged and wasted.

In addition, in the cosmetics container according to this embodiment, the brush as the applying member 220 and the discharge port 210 are not only independently formed in the discharge head 200 but also are located in the opposite direction, thereby preventing water or alien substances from being introduced into the discharge port 210 when the brush is washed.

Figure 5:
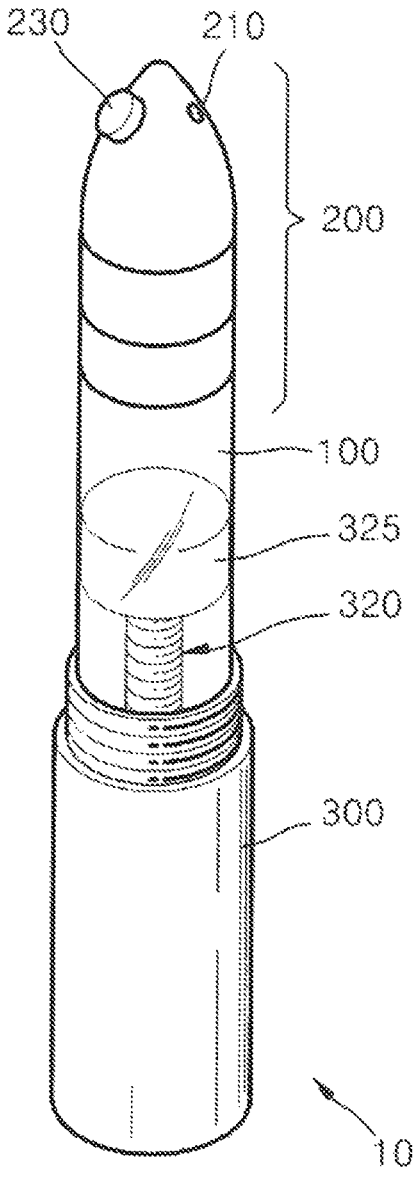
FIG. 5 is a perspective view showing a cosmetic container according to a second embodiment of the present invention.

FIG. 5 is a perspective view showing a cosmetic container according to a second embodiment of the present invention.

As shown, an applying member 230 of the cosmetics container according to this embodiment is a sponge which is independently formed separately from the discharge port 210.

The rest has the same configuration as the first embodiment and, therefore, explanation of which will not be repeated.

Figure 6:
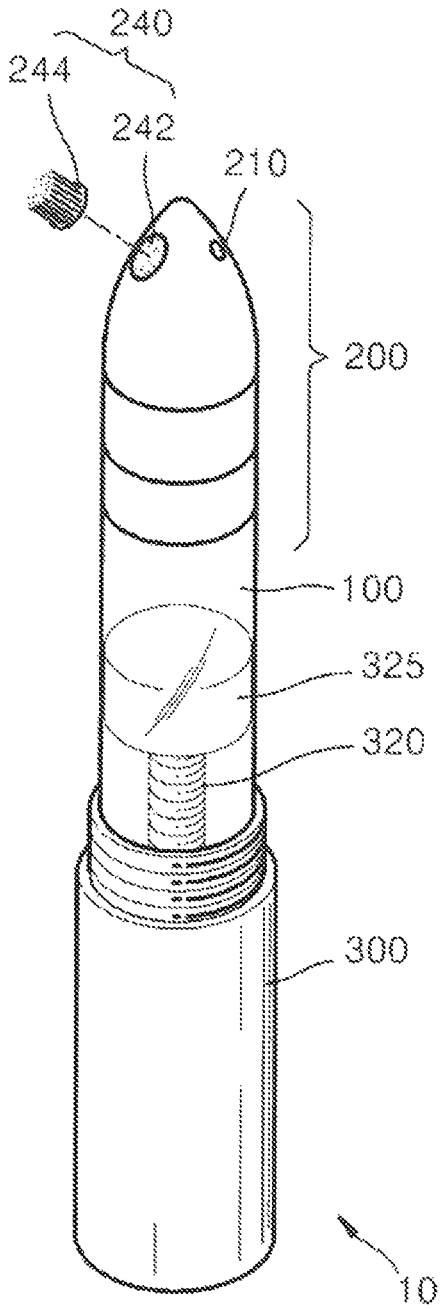
FIG. 6 is a perspective view showing a cosmetic container according to a third embodiment of the present invention.

FIG. 6 is a perspective view showing a cosmetic container according to a third embodiment of the present invention.

As shown, an applying member 240 of the cosmetics container according to this embodiment is installed to be detached from the discharge head 200.

The applying member 240 includes a brush 244 which can be attached to/detached from the outer side of the discharge head 200, and a Velcro tape 242 which is installed in the discharge head 200 for attachment/detachment of the brush 244.

The brush 244 has a structure in which it is attached to/detached from the discharge head 200 through the Velcro tape 242. In washing the brush 244, only the brush 244 can be detached from the discharge head 200 and can be again attached to the discharge head 200 after being washed.

The rest has the same configuration as the first embodiment and, therefore, explanation of which will not be repeated.

Figure 7:
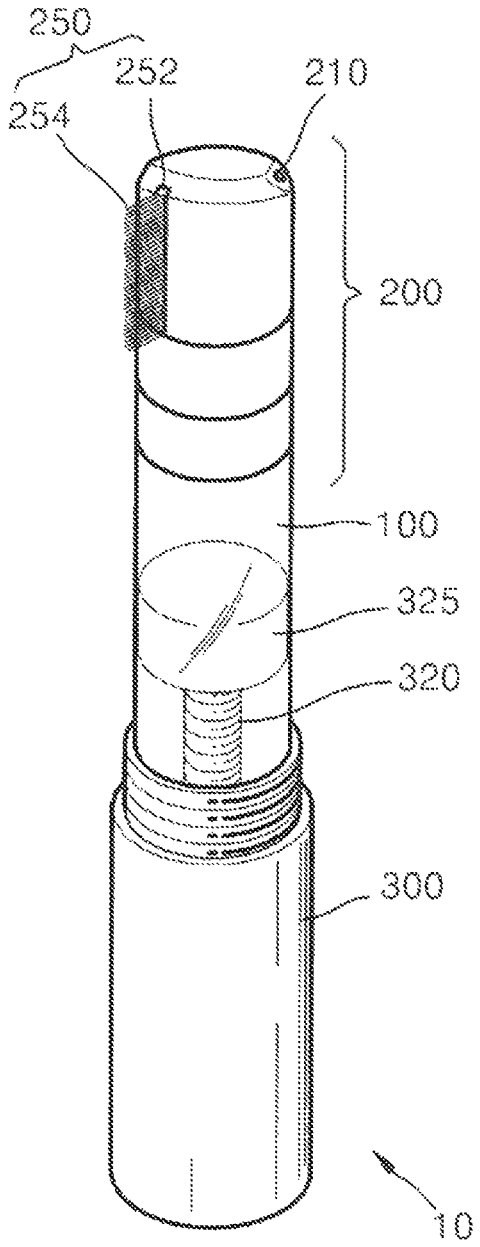
FIG. 7 is a perspective view showing a cosmetic container according to a fourth embodiment of the present invention.

FIG. 7 is a perspective view showing a cosmetic container according to a fourth embodiment of the present invention.

As shown, an applying member 250 of the cosmetics container according to this embodiment is fitted into the discharge head 200.

The applying member 250 is a brush 254 and an insertion groove 252 is formed in the discharge head 200.

Here, the applying member 250 is fitted into the insertion groove 252 and can be separated from the discharge head 200 for washing.

This embodiment has an advantage in that a user can install various types of brushes 252 depending on usage.

The rest has the same configuration as the first embodiment and, therefore, explanation of which will not be repeated.

Figure 8:
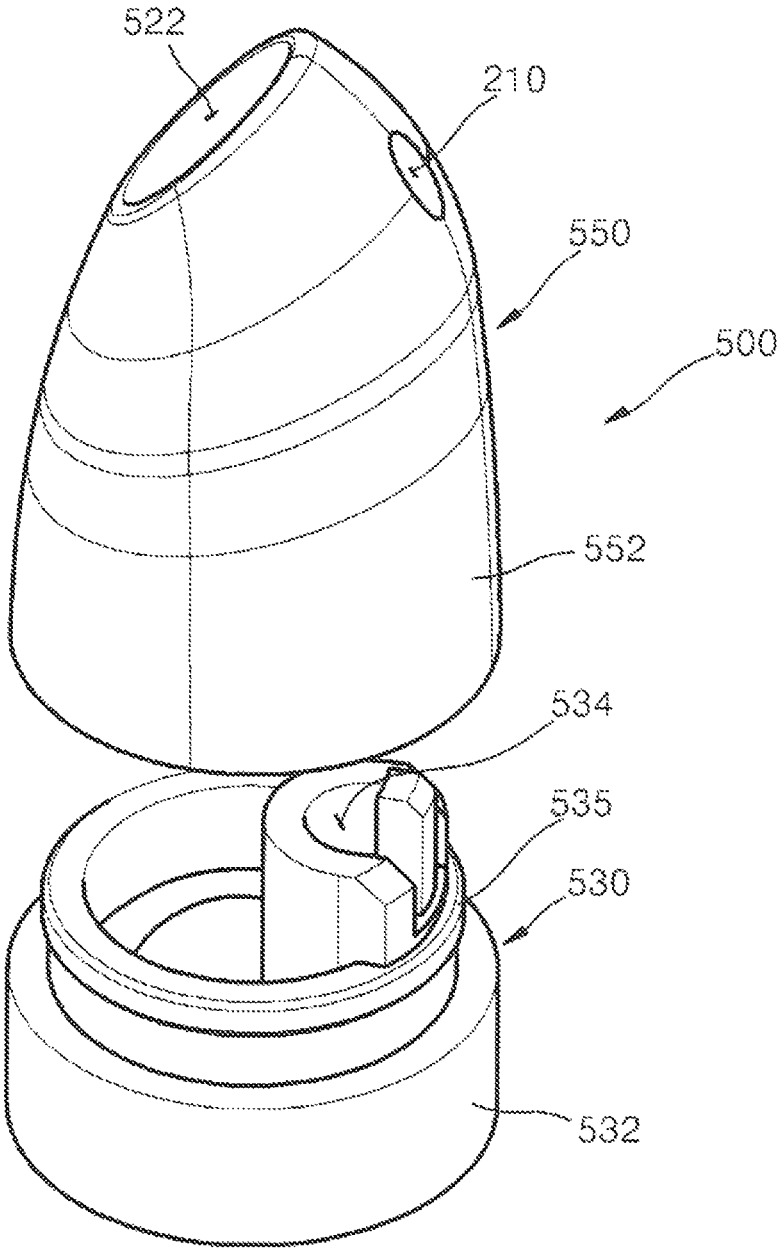
FIG. 8 is a perspective view showing a cosmetic container according to a fifth embodiment of the present invention.
Figure 9:
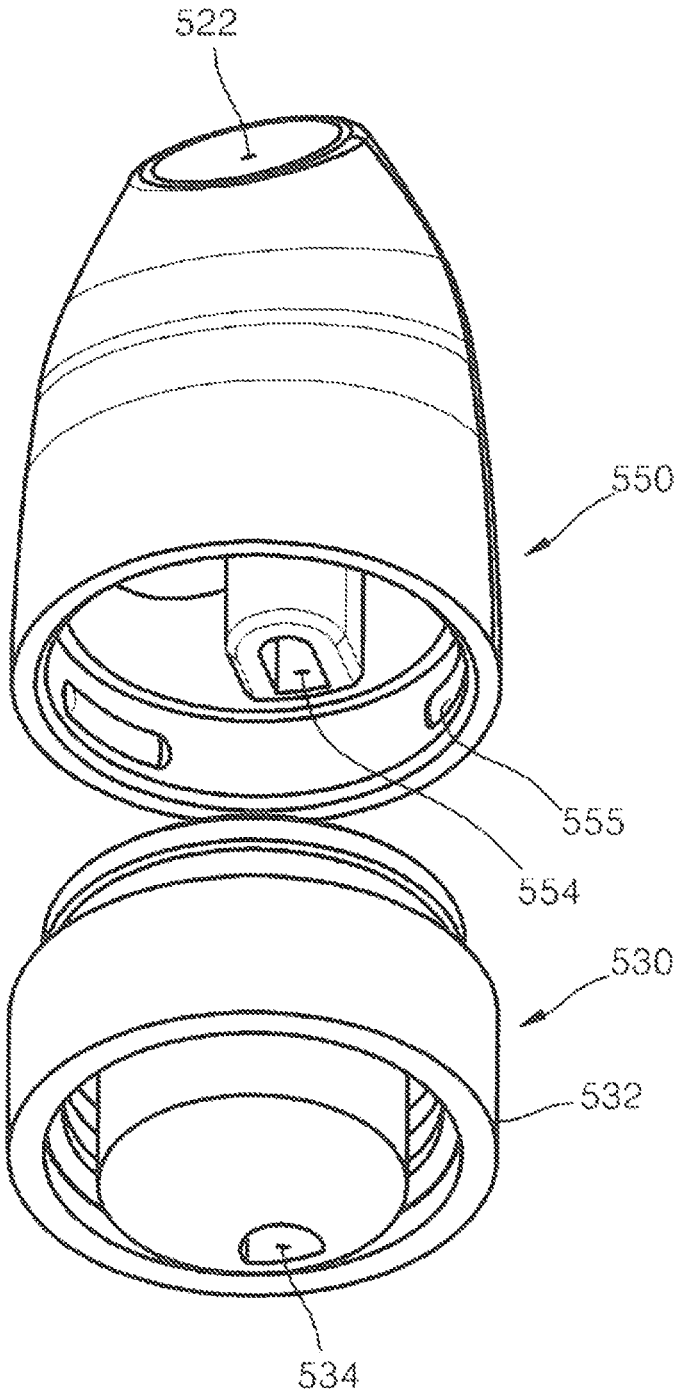
FIG. 9 is a perspective view when viewed from bottom in FIG. 8.
Figure 10:
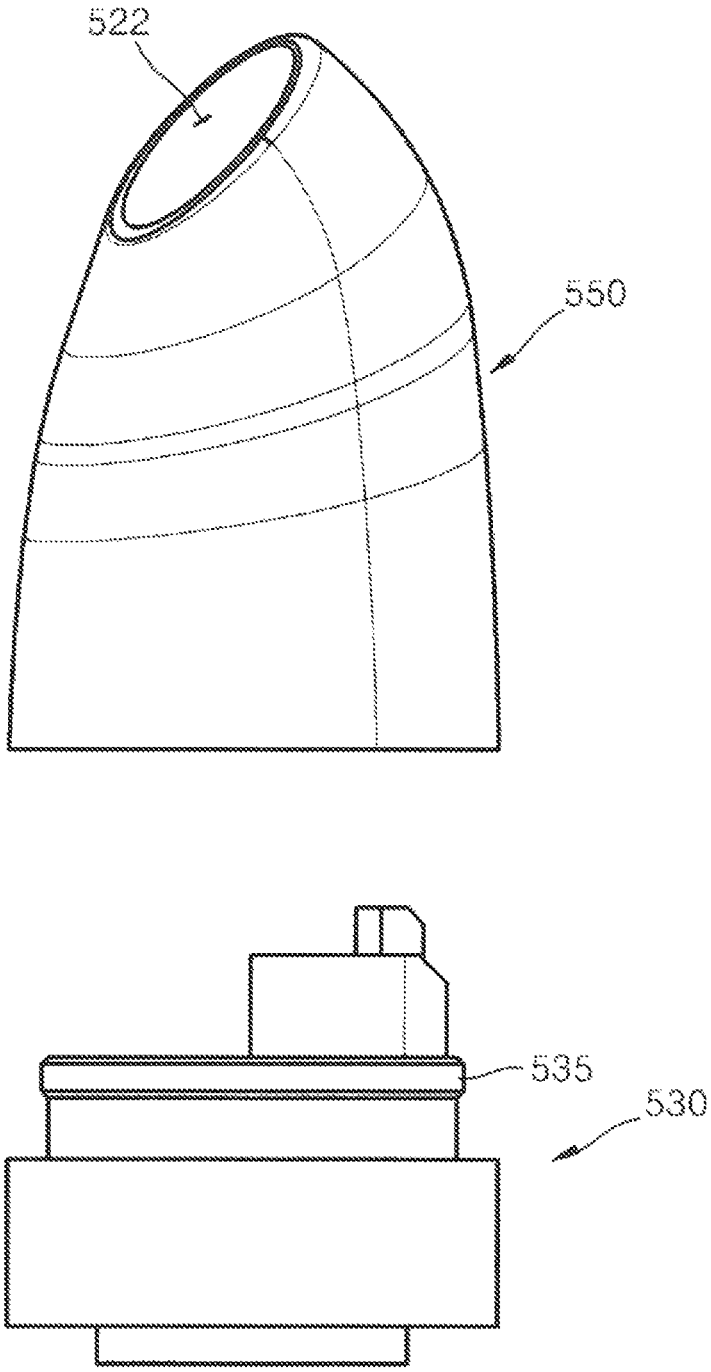
FIG. 10 is a front view of FIG. 8.
Figure 11:
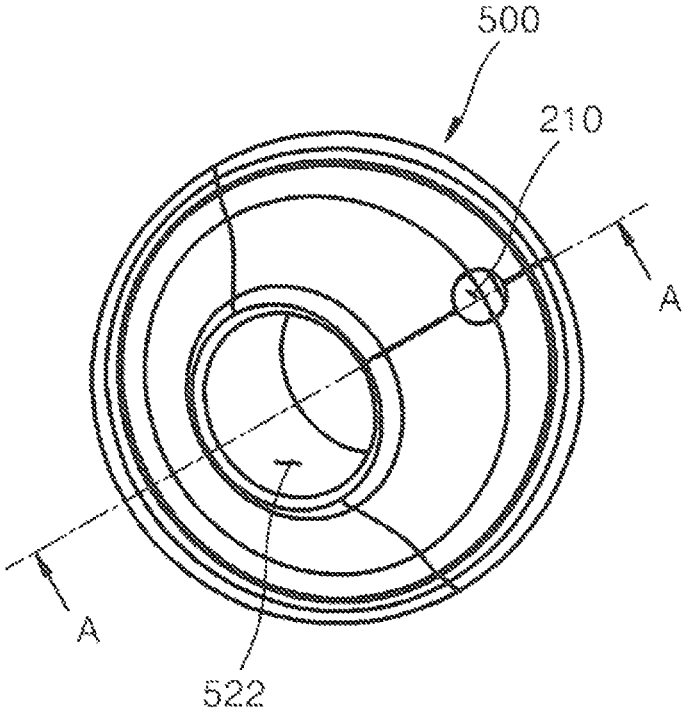
FIG. 11 is a plan view of FIG. 8.
Figure 12:
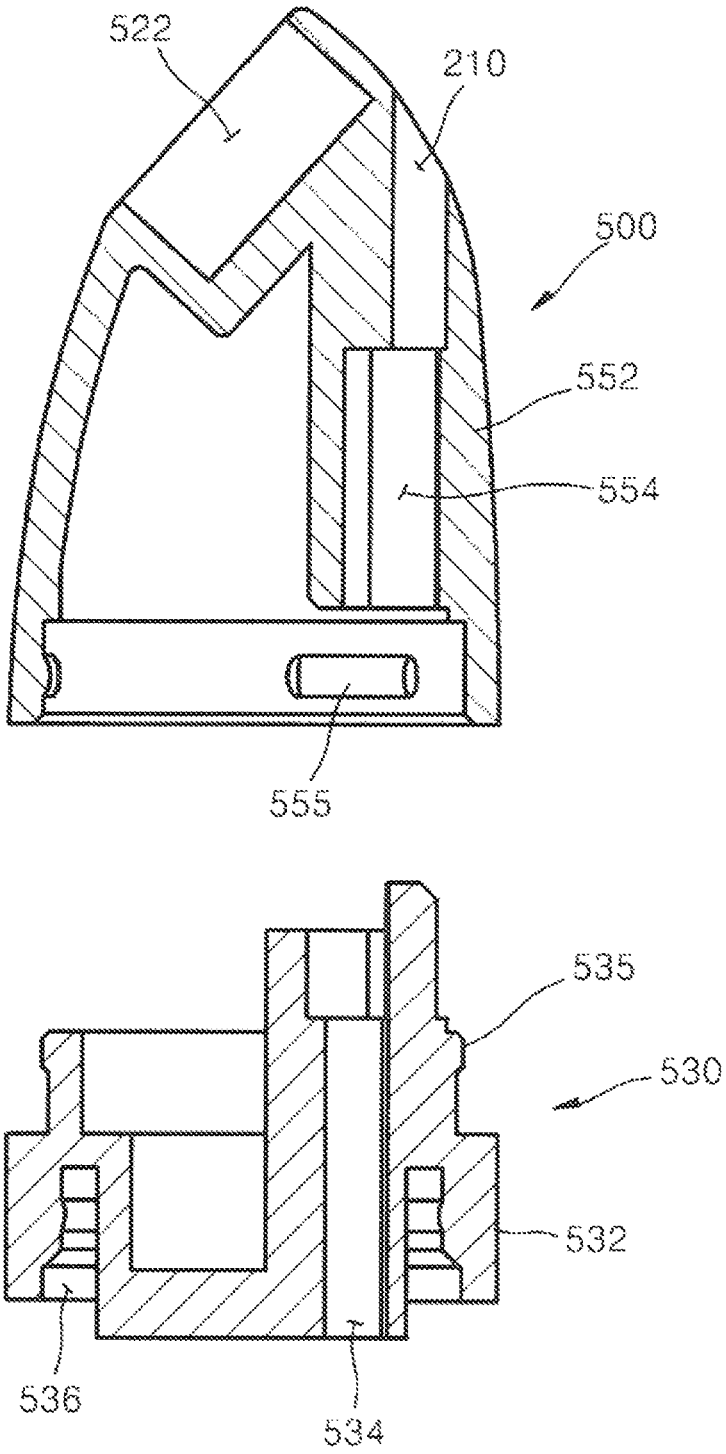
FIG. 12 is a sectional view taken along line A-A in FIG. 11.

FIG. 8 is an exploded perspective view showing a discharge head according to a fifth embodiment of the present invention, FIG. 9 is a perspective view when viewed from bottom in FIG. 8, FIG. 10 is a front view of FIG. 8, FIG. 11 is a plan view of FIG. 8 and FIG. 12 is a sectional view taken along line A-A in FIG. 11.

As shown, a discharge head 500 according to this embodiment includes a head base 530 which is combined and fixed to the upper body 100 and guides cosmetics discharged through the piston 323 of the upper body 100, and a head cover 550 which is combined to the head base 530 and includes an installation groove 522 in which an applying member is installed and a discharge port 210 through which the cosmetics are discharged.

The head base 530 includes a head base body 532, a head base passage 534 which is formed in the head base body 532 and guides cosmetics, which are supplied from the upper body 100, to the discharge port 210, and a head base fastening part 536 which is formed in the head base body 532 and into which the top of the upper body 100 is inserted and fitted.

A head base projection 535 combined and fixed to the head cover 550 is formed in the outer side of the head base body 532.

The head cover 550 includes a head cover body 552 which is combined, to the head base 530 and has the discharge port 210 and the installation groove 522, and a head cover passage 554 which is formed in the head cover body 552 and connects the head base passage 534 and the discharge port 210.

In addition, a head cover projection 555 engaging the head base projection 535 is formed in the inner side of the head cover 550.

In assembly of the head base 530 and the head cover 550, the head base passage 534 and the head cover passage 554 are interconnected and the cosmetics supplied from the upper body 100 are moved to the discharge port 210 via the head base passage 534 and the head cover passage 554.

A discharge passage is formed in the discharge head 500 by the interconnection of the head base passage 534 and the head cover passage 554.

Here, since the discharge passage is formed in a narrow pipe shape, contact of fluid cosmetics with oxygen can be minimized and the amount of cosmetics discharged according to movement of the piston can be more precisely adjusted.

That is, the discharge passage is formed to be smaller in volume than the cosmetics discharged according to the movement of the piston 335, thereby allowing the cosmetics discharged through the discharge port 210 to be more precisely adjusted even when a user moves the piston 335 less.

The rest has the same configuration as the first embodiment and, therefore, explanation of which will not be repeated.

While the present invention has been particularly shown and described with reference to exemplary embodiments thereof, it will be understood by those skilled in the art that various changes in form and details may be made therein without departing from the spirit and scope of the present invention. The exemplary embodiments are provided for the purpose of illustrating the invention, not in a limitative sense. Thus, it is intended that the present invention covers the modifications and variations of this invention provided they come within the scope of the appended claims and their equivalents.

What is claimed is:

1. A cosmetics container comprising:

a discharge head (200) including a discharge port (210) and an applying member which are formed independent of each other;

an upper body (100) which is combined and assembled to the discharge head (200) and contains cosmetics;

a piston (325) which is disposed in the upper body (100) and pressurizes and discharges the contained cosmetics to the discharge port (210); and a lower body (300) which is combined to the upper body (100) and discharges the cosmetics by moving the piston (325) to the discharge port (210) through rotation relative to the upper body (100), wherein the lower body (300) includes:

a lower shell (302) formed therein with an empty space;

a guide shaft (310) formed in the empty space of the lower shell (302);

a screw cap (330) combined and fixed to the upper body (302);

a screw shaft (320) whose upper side is fixed to the piston (325) and whose lower side is assembled with the guide shaft (310), wherein the screw shaft (320) is horizontally rotated along with the guide shaft (310) and is axially relatively moved along the guide shaft (310) to move the piston (325) upward and the screw shaft (3200 has axial threads (324) formed in the circumferential surface; and an interference part (335) which has cap threads (334) formed to cause mutual interference with the axial threads (324), is formed in the screw cap (330), raises the screw shaft (320) by mutual engagement of the axial threads (324) and the cap threads (334) when the upper body (100) and the lower body (300) are forward rotated relative to each other, and releases the mutual engagement of the axial threads (324) and the cap threads (334) while being bent by the mutual interference when the upper body (100) and the lower body (300) are backward rotated relative to each other.

2. The cosmetic container according to claim 1, wherein the applying member is at least one of a brush and a sponge.

3. The cosmetic container according to claim 1, wherein the applying member is installed to be detached from the discharge head (200).

4. The cosmetic container according to claim 1, wherein the applying member is disposed in the opposite side to the discharge port (210).

5. The cosmetic container according to claim 1, wherein the discharge head includes:

a head base (530) which is combined and fixed to the upper body (100) and guides the cosmetics pressurized through the piston (325) of the upper body (100); and a head cover (550) which is combined to the head base (530) and has the applying member and the discharge port (210) formed in the outer side of the head cover (550), wherein a head base passage (534) and a head cover passage (554) guiding the cosmetics pressurized in the upper body (100) to the discharge port (210) are formed in the head base (530) and the head cover (550), respectively, and are interconnected.

6. The cosmetic container according to claim 1, wherein the interference part (335) is formed in an L-like shape and is deformed to be bent outward in the radial direction of the screw cap (330) in the backward rotation.

7. The cosmetic container according to claim 1, wherein the interference part (335) is formed in a cantilever shape in the inner side of the screw cap (330).

8. The cosmetic container according to claim 1, wherein the piston (325) is moved to the discharge port (210) through mutual interference by engagement of the axial threads (324) and the cap threads (334) when the lower body (300) is forward rotated relative to the upper body (100), and wherein the screw axis (320) is idle rotated in place as the cap threads (334) is separated from the axial threads (324) by the bending deformation of the interference part (335) when the lower body (300) is backward rotated relative to the upper body (100).

* * * * *